United States Patent [19]

DeTommaso

[11] Patent Number: 4,923,330

[45] Date of Patent: May 8, 1990

[54] STORM WATER INJECTION WELL

[76] Inventor: Stephen C. DeTommaso, 8637 E. Roma, Scottsdale, Ariz. 85251

[21] Appl. No.: 139,915

[22] Filed: Dec. 31, 1987

[51] Int. Cl.[5] ..... E02B 11/00

[52] U.S. Cl. ..... 405/36; 405/50; 405/48

[58] Field of Search ..... 405/36, 43, 45, 48, 405/37, 50

[56] References Cited

U.S. PATENT DOCUMENTS

| | | | |
|---|---|---|---|
| 548,823 | 10/1895 | Walker . | |
| 601,794 | 4/1895 | Hershberger . | |
| 809,201 | 1/1906 | Lutz . | |
| 885,209 | 4/1908 | Wise . | |
| 1,015,530 | 1/1912 | Appelman | 405/45 |
| 1,405,725 | 2/1922 | Snively . | |
| 1,473,358 | 11/1923 | Probst . | |
| 1,654,247 | 12/1927 | Egan . | |
| 1,654,803 | 1/1928 | Griffith . | |
| 1,655,191 | 1/1928 | Linnmann, Jr. . | |
| 2,767,801 | 10/1956 | Eads | 405/36 X |
| 3,038,396 | 6/1962 | Jameson, Jr. et al. | 405/43 X |
| 3,212,519 | 10/1965 | Paschen . | |
| 3,501,007 | 3/1970 | Davis . | |
| 3,579,995 | 5/1971 | Flynn | 405/48 X |
| 3,759,280 | 9/1973 | Swanson . | |
| 3,815,749 | 6/1974 | Thompson . | |
| 3,870,422 | 3/1975 | Medico, Jr. . | |
| 4,199,272 | 4/1980 | Lacey | 405/36 |
| 4,366,846 | 1/1983 | Curati, Jr. . | |
| 4,624,604 | 11/1986 | Wagner et al. . | |
| 4,720,209 | 1/1988 | Iams | 405/36 |

OTHER PUBLICATIONS

McGuckin Drilling Inc., "*The Maxwell III*", Product Catalog 880-1, Aug. 1980.

*Primary Examiner*—Randolph A. Reese
*Assistant Examiner*—J. Russell McBee
*Attorney, Agent, or Firm*—Cahill, Sutton & Thomas

[57] ABSTRACT

A storm water injection well incorporating a precast settling chamber having an overflow pipe extending upwardly into the chamber. The top of the overflow pipe is covered with a debris screen which in turn is covered by a debris shield. The shield is supported above the open end of the pipe and extends downwardly over the pipe end displaced radially from the surface of the pipe to form an annular passageway between the shield and the pipe to permit storm water to flow upwardly in the passageway into the pipe. An anti-siphon vent is provided in the debris shield. The precast settling chamber includes a plurality of weep holes sloped upwardly from the inside to the outside of the chamber. A drainage pipe is connected to the overflow pipe and delivers water from in the pipe to backfill in a ground hole through an injection screen.

12 Claims, 1 Drawing Sheet

STORM WATER INJECTION WELL

FIELD OF THE INVENTION

The present invention relates to systems for the return of collected storm water to the soil; and more specifically, to the structure of wells for directing collected storm water into the ground, sometimes referred to as storm water recharge systems and more particularly storm water injection wells.

BACKGROUND

In many locations storm water collection systems for returning the water to storm sewers and the like are not available; however, the relatively large volume and rate of flow of such storm water must nevertheless be appropriately collected and channeled for return to the soil. In its most rudimentary sense, an injection well may simply be a hole in the ground filled with suitable rock backfill into which the water to be disposed is directed. Such simple wells, and a variety of improvements and modifications there of, are appropriate for application to domestic waste water or other systems having similar water flow rates (generally approximately 1,500 gallons per day). In contrast to such modest flow rates, storm water collection systems must accommodate intermittent but periodically recurring flow rates of significantly higher magnitude. For example, flow rates of one to two cubic feet per second (over 1 million gallons per day) must be accommodated by single storm water injection wells of the type described herein.

Since the water rates are extremely high prior art structures have concentrated techniques for accommodating such large flow rates and disposing of the storm water. The prior art has also addressed the difficulty of system clogging or clogging of a backfill medium by silt washed into the system with the storm water. To separate such silt from the water it was typical to employ a settling chamber which would hopefully permit an appropriate quantity of the storm water to stand a sufficient length of time to permit silt particles to settle out of the water prior to its being discharged to the surrounding soil. Similarly, prior art techniques have used filters in an attempt to block the passage of such silt into the soil.

Notwithstanding prior art endeavors, the transmission of silt, debris and trash can create severe problems over a period of time with such prior art storm water injection wells. Concentrated sources of unwanted materials such as landscape surface silt and debris (mulch, peat moss, grass, sediment from erosion) can severely decrease injection well efficiency. Another significant difficulty encountered with such injection wells is the fact that the storm water frequently is being collected from surfaces that are paved or are covered with other composition materials. Further, the areas being drained usually are associated with vehicles such as roads and parking lots. Accordingly, pavement oils and other impurities are washed by the storm water into the injection well. The recharging of ground water with such storm water can very easily become a health hazard as a result of oils or other chemicals that eventually find their way through the soil to subterranean aquifer. Such pavement oils also seriously adversely affect the performance of the injection well by clogging the surrounding soil and reducing the capacity of the well and its ability to accommodate large flow rates.

OBJECTS OF THE INVENTION

It is therefore an object of the present invention to provide a storm water injection well that can readily separate silt trash and debris from storm water to permit the water to flow unimpeded to the surrounding drainage soils.

It is also an object of the present invention to provide a storm water injection well incorporating an effective means for inhibiting the flow of pavement oils and similar substances from flow into the surrounding soils.

It is still another object of the present invention to provide a storm water injection well that may be conveniently and economically maintained.

It is another object of the present invention to provide a storm water injection well capable of separating silt, trash, debris and pavement oils from storm water prior to returning the water to the surrounding soil to thereby reduce clogging of the backfill media and the surrounding soil.

It is still another object of the present invention to provide a storm water injection well incorporating a means for venting entrapped air in certain soil zones to prevent air blockage in the soil that would otherwise reduce the well's percolation rate.

These and other advantages of the present invention will become more apparent to those skilled in the art as the description thereof proceeds.

SUMMARY OF THE INVENTION

Briefly, in accordance with one embodiment of the invention, a precast settling chamber is positioned within an excavated shaft provided therefor such that the top of the settlement chamber is positioned at a predetermined distance below grade level. The settlement chamber is provided with a plurality of weep holes strategically positioned about the periphery thereof each of which is sloped upwardly from the inside to the outside of the settling chamber. A modified manhole cone is positioned on top of the settlement chamber and extends to the grade level to define a manhole for admitting storm water. An overflow pipe extends upwardly into the chamber and terminates at an open end; a debris screen is mounted the overflow pipe and extends upwardly therefrom to permit water to flow therethrough into the overflow pipe but exclude trash and debris. A debris shield is mounted on the debris screen and comprises a depending cylindrical member having a closed top which extends downwardly over the debris screen and the overflow pipe to a predetermined depth the debris shield is sufficiently larger than the overflow pipe so that its walls are displaced from the pipe to form an annular passageway therebetween to permit storm water to flow upwardly between the shield and the pipe to the open top of the pipe.

An air vent is provided at the top of the shield to prevent siphoning of the storm water in the settling chamber as the level of the water recedes.

BRIEF DESCRIPTION OF DRAWINGS

The present invention may more readily be described by reference to the accompanying drawings in which.

DETAILED DESCRIPTION OF THE PREFERRED EMBODIMENT

Figure 1:
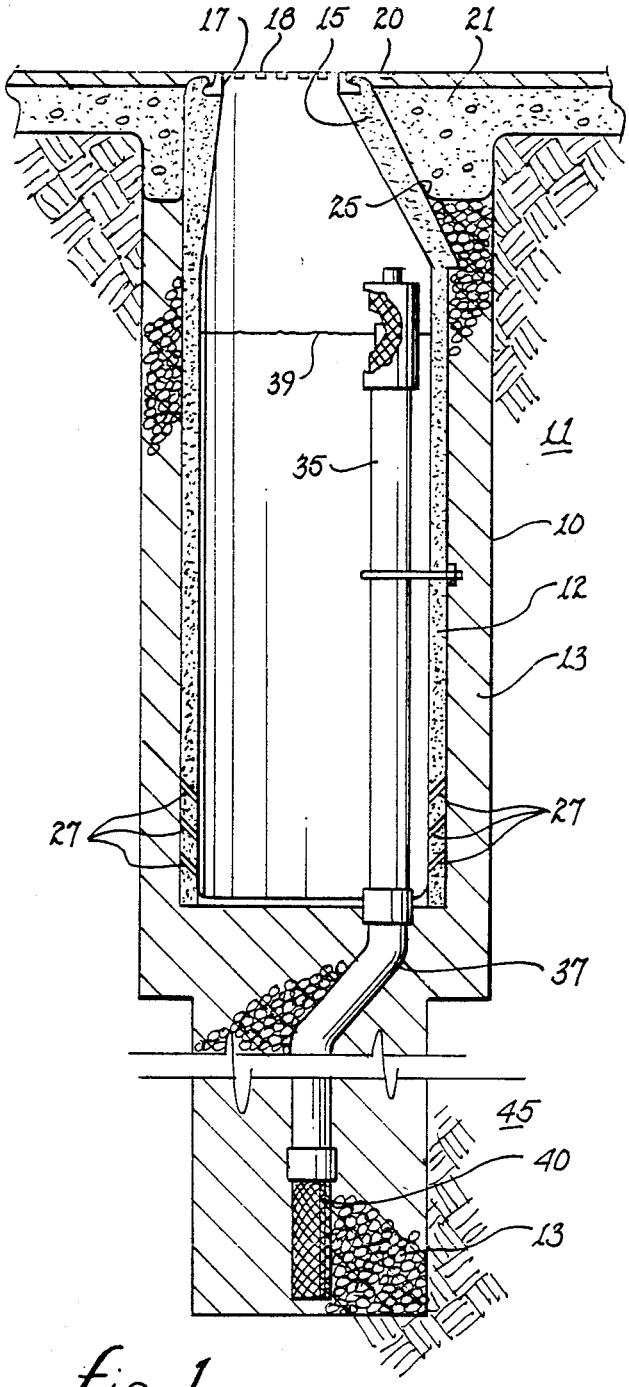
FIG. 1 is a cross-sectional view of a storm water injection well constructed in accordance with the teachings of the present invention.

Referring to FIG. 1, an excavated shaft 10 is provided in the soil 11 to receive a settling chamber that may be constructed in place or may be a precast settling chamber 12 positioned within the shaft by rock backfill 13. A manhole entry device such as a modified manhole cone 15 is positioned on top of the settling chamber to provide a manhole 17 through which storm water enters. Customarily, the manhole is covered by a metal migrate such as that shown at 18 and is positioned at grade level.

The injection well may typically be located in an area having paving 20, such as that found in parking lots, which is placed over a compacted base material 21 as is customary in such applications. A moisture barrier membrane 25 isolates the compacted base material from moisture that would otherwise migrate upwardly from the rock backfill 13.

The settling chamber 12 is provided with a plurality of weep holes 27 positioned about the lower end of the chamber; the weep holes are inclined upwardly from the inside to the outside of the settling chamber. The degree of slope of the weep holes is approximately twenty degrees; the sloping or inclination of the holes provides a means to retain coarse silts and sands in the bottom of the chamber as the level of the storm water in the settling chamber recedes. The number and diameter of the individual weep holes will depend on various design parameters encountered for each specific application. However, it has been found that with a concrete settling chamber having a forty-eight inch inside diameter and a fifty-four inch outside diameter formed of precast reinforced 4,000 psi concrete, that eight 1.25 inch diameter weep holes per foot inclined at approximately twenty degrees arranged around the periphery of the chamber with each row or course of weep holes spaced about one foot apart vertically and with a total of three such courses or rows are adequate to permit appropriate drainage of the storm water while retaining coarse silt and sand in the chamber. The bottom of the chamber 12 is provided with a geotextile filtration fabric 30 to separate the interior of the settling chamber from the backfill rock immediately below the chamber. The filtration fabric 30 may be any of several commercially available filter materials specifically adapted for the bottom of settling chambers.

An overflow pipe 35 extends vertically upwardly into the settling chamber and terminates at its upper end a predetermined distance below grade level. The distance from the entry through the manhole 17 to the upper end of the overflow pipe 35 will depend on many application factors including such considerations as the amount and type of debris and other foreign materials expected, the rate of flow of storm water into the settling chamber, and the expected level of storm water Within the chamber. The overflow pipe provides a conduit for cleaned storm water through a drainage pipe 37 to an injection screen 40 positioned an appropriate distance beneath grade where the water can be discharged through the injection screen, through the rock backfill, and into the vadose zone 45 of the soil. The height of the overflow pipe determines the effective settling capacity and the ability of the system to retain waterborne debris and also determines maintenance scheduling and mitigation of the effects of storm peak loads. The overflow pipe diameter will vary based upon the need for rapid absorption of the water into the well and venting.

The injection screen 40 is a long highly perforated screen for permitting the transmission of the storm water, operating under the pressure created by the head existing in the overflow pipe, to and through the backfill rock and ultimately into the native soil in the vadose zone.

Figure 2:
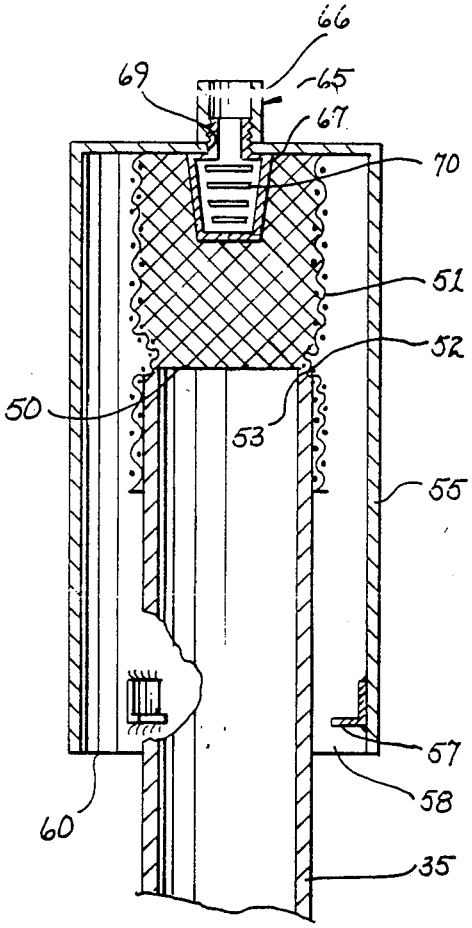
FIG. 2 is an enlarged cross-sectional view of a portion of the injection well of FIG. 1 showing the debris shield.

The upper portion of the overflow pipe, with its related apparatus, may best be seen by reference to FIG. 2. The open top 50 of the overflow pipe 35 supports a debris screen 51 which extends upwardly therefrom and acts to prevent floating debris from entering the overflow pipe. The debris screen 51 may be supported in position in any convenient manner, but is most readily supported by attachment to the pipe 35; in the embodiment shown in FIG. 2, the screen 51 is provided with a circumferential groove 52 formed in the screen by rolling such that an internal ledge 53 is formed that rests upon the upper opening of the overflow pipe 35.

A debris shield 55 of a rigid material is formed into a cylindrical shape that is positioned over the debris screen 51 and extends downwardly therefrom to a level below the opening 50 of the overflow pipe 35. The debris shield may be mounted in its position in any convenient manner; however, in the embodiment shown in FIG. 2 the shield is supported by the vertically extending debris screen 51 and is maintained generally concentrically with respect to the overflow pipe 35 by means of circumferentially spaced tabs 57 located 120° apart on the interior of the shield. In this manner, the shield is mounted over the open end of the overflow pipe and forms an annular passageway 58 between the pipe and the shield such that storm water must flow upwardly into the passageway, through the debris screen and into the open end 50 of the overflow pipe. The extent to which the lower end 60 of the debris shield 55 is below the opening 50 of the overflow pipe 35 will depend on several factors. It was previously mentioned that the distance from the top of the overflow pipe to the manhole opening is a predetermined distance predicated on numerous design factors. Similarly, the length of the debris shield depends on design factors. For example, if the distance from the manhole to the top of the overflow pipe is very great, then it may be anticipated that when the water level in the settling chamber reaches approximately the level of the upper portion of the overflow pipe, that the turbulence created by the water falling into the standing water in the settling chamber will cause violent mixing of pavement oil and similar materials with the water adjacent the overflow pipe. It would therefore be possible that materials with a lower density than the water. (and thus materials such as oil that would float on the surface) would be forced by the impact of incoming storm water beneath the surface of the level of the water in the settling chamber to such a depth that the oils and other materials would enter the passageway 58 and travel upwardly and into the overflow pipe. This latter condition is the specific condition which the present invention is intended to avoid. Therefore, it is important that the debris shield extend sufficiently below the upper open end of the overflow pipe to prevent any such entrained oil or similar material from entering the passageway 58. For example, it has been found that in the above-mentioned example of settlement chamber sizes, that if the distance from the manhole 17 to the top of the overflow pipe 35 is approximately five feet, then the debris shield 55 should extend approximately two feet below the upper open end of the overflow pipe 35.

It is also important, to assure the utilization of the full water rate handling potential of the system, that the cross-sectional area of the annular passageway 58 be at least equal to the cross-sectional area of the overflow tube 35. If the annular cross-sectional area is less than the cross-sectional area of the overflow pipe, then the pipe and connected components in the overall system will not be used to their ultimate design potential since the rate of flow will be restricted by the area of the annular passageway 58.

The typical design water level is shown at 39. At this level, water would enter the overflow pipe only by traveling upwardly through the annular passage 58 no fluids from the surface of the water enter the overflow pipe. As water travels down the overflow pipe into and through the drainage pipe to the soil beneath the well there are frequently areas of entrapped air within the vadose zone of the soil. Such entrapped air can create air-blocks in the soil which severely reduce the percolation rate through the soil. To alleviate the difficulties with such entrapped air, an anti-siphon vent 65 is provided in the top of the debris shield 55 thus permitting air to escape upwardly through the vent to the atmosphere. The air vent may be secured to the debris shield in any convenient manner; however, in the embodiment shown in FIG. 2 the air vent comprises an upper and lower portion 66 and 67, respectively, having mating threaded portions engaged through an opening 69 provided in the top of the debris shield. The lower portion 67 includes a plurality of openings or slots 70 which provide communication from the exterior of the lower portion 67. The slots 70 prevent minute quantities of floating matter from entering the shield when the water level in the settling chamber is high. The anti-siphon vent prevents siphoning of storm water constituents with a density lower than water from entering the overflow pipe as the water level in the settling chamber recedes; further, it allows entrapped air in the vadose zone of the soil that is being replaced by the incoming storm water to vent to the atmosphere thus preventing the previously mentioned air blocks in the soil.

Figure 3:
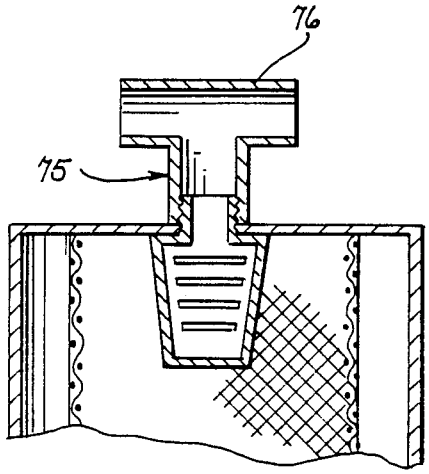
FIG. 3 is an enlarged sectional view of a portion of the debris shield of FIG. 2 showing an alternative structural configuration.

Referring now to FIG. 3, the anti-siphon vent 75 is shown having covered upper portion 76 formed of a T-shaped pipe-like fitting. The covering of the air vent passageway is particularly useful in those instances where the debris shield, and its attendant anti-siphon vent, are positioned such that incoming falling storm water may impinge on the debris shield. In those instances, water would otherwise directly flow through the anti-siphon vent to the interior of the debris shield and into the overflow pipe. To prevent that occurrence, the covered opening such as shown in FIG. 3 will prevent the incoming storm water from entering the anti-siphon vent.

What is claimed is:

1. A storm water injection well for receiving water runoff and directing said water through an excavated shaft lined with backfill, comprising:

(a) a settling chamber extending into said shaft and positioned a predetermined distance below grade level, said chamber having an open top;

(b) a manhole entry device positioned on top of said settling chamber and extending to grade level and defining a manhole for admitting storm water;

(c) an overflow pipe extending upwardly into said chamber and terminating an open end thereof a predetermined distance below grade level;

(d) a debris screen mounted to prevent debris from entering the open end of said overflow pipe; and (e) a debris shield mounted over and covering said open end and extending downwardly along said overflow pipe a predetermined distance to form an annular passageway between the shield and the overflow pipe to permit storm water to flow upwardly through said passageway into said overflow pipe.

2. The combination set forth in claim 1 including a drainage pipe connected to said overflow pipe and extending downwardly therefrom terminating in an injection screen extending downwardly into rock backfill provided at the bottom of said shaft.

3. The combination set forth in claim 1 wherein said debris shield includes an anti-siphon vent at the top thereof.

4. The combination set forth in claim 1 wherein said annular passageway has a cross-sectional area at least equal to the cross sectional area of said overflow pipe.

5. A storm water injection well for receiving water runoff and directing said water through an excavated shaft lined with backfill, comprising:

(a) a precast settling chamber extending into said shaft and positioned a predetermined distance below grade level, said chamber having an open top;

(b) a manhole cone positioned on top of said settling chamber and extending to grade level and defining a manhole for admitting storm water;

(c) an overflow pipe extending upwardly into said chamber and terminating at an open end thereof a predetermined distance below grade level;

(d) a debris screen mounted on said overflow pipe to prevent debris from entering the open end of said overflow pipe; and (e) a debris shield mounted over and covering said debris screen and said open end and extending downwardly along said overflow pipe a predetermined distance to form an annular passageway between the shield and the overflow pipe to permit storm water to flow upwardly through said passageway into said overflow pipe.

6. The combination set forth in claim 5 including a drainage pipe connected to said overflow pipe and extending downwardly therefrom terminating in an injection screen extending downwardly into rock backfill provided at the bottom of said shaft.

7. The combination set forth in claim 5 wherein said debris shield includes an anti-siphon vent at the top thereof.

8. The combination set forth in claim 5 wherein said annular passageway has a cross-sectional area at least equal to the cross-sectional area of said overflow pipe.

9. The combination set forth in claim 5 wherein said precast settling chamber includes a plurality of weep holes extending through sides thereof, said weep holes inclined upwardly from inside to outside of said settling chamber.

10. A storm water injection well for receiving water runoff and directing said water through a ground hole lined with backfill comprising:

(a) a precast settling chamber extending into said hole and positioned a predetermined distance below grade level, said chamber having an open top and an open bottom, a filtration fabric extending across said open bottom;

(b) a manhole cone positioned on top of said settling chamber extending to grade level and defining a manhole for admitting storm water;

(c) an overflow pipe extending upwardly into said chamber and terminating at an open end thereof a predetermined distance below grade level;

(d) a debris screen mounted on said overflow pipe and extending upwardly from the open end of said pipe to permit storm water to flow through the screen into the open end of said pipe and to prevent debris from entering the open end of said pipe;

(e) a debris shield mounted on said debris screen and extending over and covering said debris screen and said open end, and extending downwardly along said overflow pipe a predetermined distance to form an annular passageway between the shield and the overflow pipe to permit storm water to flow upwardly through said passageway into said overflow pipe, said passageway having a cross-sectional area at least equal to the cross-sectional area of said overflow pipe; and (f) an anti-siphon vent positioned in the top of said debris shield, said vent positioned beneath said shield and extending through an opening at the top of said shield to communicate with the atmosphere above the shield; the portion of said vent beneath said shield including a plurality of slots to prevent floating matter from entering the shield.

11. The combination set forth in claim 10 including a drainage pipe connected to said overflow pipe and extending downwardly therefrom terminating in an injection screen extending downwardly into rock backfill provided at the bottom of said hole.

12. The combination set forth in claim 10 wherein said precast settling chamber includes a plurality of weep holes extending through sides thereof, said weep holes inclined upwardly from inside to outside of said settling chamber.

* * * * *